US010907323B1

(12) United States Patent
Takimoto et al.

(10) Patent No.: US 10,907,323 B1
(45) Date of Patent: Feb. 2, 2021

(54) HYDRAULIC DRIVE DEVICE FOR WORKING MACHINE

(71) Applicant: Hitachi Construction Machinery Co., Ltd., Tokyo (JP)

(72) Inventors: Yoshifumi Takimoto, Ibaraki (JP); Kazuo Takiguchi, Ibaraki (JP); Chinori Iio, Ibaraki (JP); Jun Okamura, Ibaraki (JP); Hiromasa Takahashi, Chiba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/976,576

(22) PCT Filed: Aug. 5, 2019

(86) PCT No.: PCT/JP2019/030767
§ 371 (c)(1),
(2) Date: Aug. 28, 2020

(87) PCT Pub. No.: WO2020/031974
PCT Pub. Date: Feb. 13, 2020

(30) Foreign Application Priority Data

Aug. 10, 2018 (JP) ..... 2018-151069

(51) Int. Cl.
*E02F 9/22* (2006.01)

(52) U.S. Cl.
CPC ..... *E02F 9/2292* (2013.01); *E02F 9/2267* (2013.01); *E02F 9/2228* (2013.01); *F15B 2211/20576* (2013.01)

(58) Field of Classification Search
CPC ..... E02F 9/2289; E02F 9/2292; E02F 9/2239; E02F 9/2242
See application file for complete search history.

(56) References Cited

U.S. PATENT DOCUMENTS 9,068,578 B2 * 6/2015 Opdenbosch ..... E02F 9/2289
9,783,960 B2 * 10/2017 Shimizu ..... E02F 9/2278
(Continued)

FOREIGN PATENT DOCUMENTS

EP 2 982 868 A1 2/2016
JP 2008-127129 A 6/2008
JP 2017-53383 A 3/2017

OTHER PUBLICATIONS

International Search Report (PCT/ISA/210) issued in PCT Application No. PCT/JP2019/030767 dated Oct. 29, 2019 with English translation (three pages).
(Continued)

*Primary Examiner* — Abiy Teka
(74) *Attorney, Agent, or Firm* — Crowell & Moring LLP

(57) ABSTRACT

There is provided a hydraulic drive device for a working machine with which a number of times of maintenance can be reduced. A controller (20) opens a first on-off valve (25*a*), closes a second on-off valve (25*b*), switches a first directional switching valve (30*a*) to a first position (A), and switches a second directional switching valve (30*b*) to a third position (C), thereby pressure oil from a hydraulic pump (1*a*) is supplied from the first on-off valve to an actuator (5*a*) through the first directional switching valve. When history data of the first on-off valve is determined to satisfy a prescribed condition, the controller closes the first on-off valve, opens the second on-off valve, switches the first directional switching valve to a second position (B), and switches the second directional switching valve to a fourth position (D), thereby pressure oil from the hydraulic pump is supplied from the second on-off valve to the actuator through the second directional switching valve. For example, the controller determines that the prescribed con-
(Continued)

dition is satisfied when an operation number of times of the first on-off valve reaches a first prescribed value.

10 Claims, 14 Drawing Sheets

(56) References Cited

U.S. PATENT DOCUMENTS

| | | | | |
|---|---|---|---|---|
| 10,829,908 | B2 * | 11/2020 | Saitoh | E02F 9/2292 |
| 2013/0312399 | A1 * | 11/2013 | Hiraku | E02F 9/2217<br>60/422 |
| 2014/0165543 | A1 * | 6/2014 | Takebayashi | E02F 3/325<br>60/311 |
| 2014/0227104 | A1 * | 8/2014 | Takahashi | E02F 9/207<br>417/42 |

OTHER PUBLICATIONS

Japanese-language Written Opinion (PCT/ISA/237) issued in PCT Application No. PCT/JP2019/030767 dated Oct. 29, 2019 (three pages).

* cited by examiner

HYDRAULIC DRIVE DEVICE FOR WORKING MACHINE

TECHNICAL FIELD

The present invention relates to a hydraulic drive device for a working machine.

BACKGROUND ART

With respect to a working machine such as a hydraulic excavator used in a mine and the like, it is general to execute maintenance of a hydraulic device per certain constant working hours. The hydraulic device subject to the maintenance includes, for example, an actuator for a front working device, an actuator for traveling, a hydraulic pump, an on-off valve, and the like. With respect to each of these hydraulic devices, since the frequency of usage is different, there are hydraulic devices requiring replacement of a component after constant working hours, and there are also hydraulic devices where replacement of a component is executed optionally according to the use condition. When maintenance is executed according to deviation of frequency of usage of each hydraulic device, the number of times of maintenance increases, availability of the working machine deteriorates, and therefore it is preferable that frequency of usage of each hydraulic device is averaged.

As a technology for averaging frequency of usage of each hydraulic device, in Patent Literature 1 for example, there is described a configuration of "a driving device for a working machine comprising a plurality of hydraulic pumps, a plurality of hydraulic actuators, and a plurality of switching valves capable of connecting one hydraulic pump to one hydraulic actuator, wherein the driving device includes a connection order changing section that takes a plurality of priority tables and an interval time from a change interval time storage unit, measures a time, and changes a priority table to be outputted when a time has reached the interval time, and a working pump calculation section that takes a requested flow rate, a number of required pumps, and a priority table outputted by the connection order changing section, calculates assignment of a plurality of hydraulic pumps to the plurality of hydraulic actuators based on the number of required pumps, and outputs a command signal to a plurality of regulators and the plurality of switching valves based on a result of the assignment" (refer to the abstract).

CITATION LIST

Patent Literature

PATENT LITERATURE 1: Japanese Patent Application Laid-Open No. 2017-53383

SUMMARY OF INVENTION

Technical Problem

However, according to the prior art disclosed in Patent Literature 1, although frequency of usage of the hydraulic pump is averaged, there is dispersion in frequency of usage of other hydraulic devices such as an on-off valve connected to the hydraulic pump, for example. In order to further reduce the number of times of maintenance, it is important to average frequency of usage of hydraulic devices other than the hydraulic pump. Therefore, the object of the present invention is to provide a hydraulic drive device for a working machine capable of reducing the number of times of maintenance.

Solution to Problem

In order to solve the problem described above, an aspect of the present invention is a hydraulic drive device for a working machine, including a hydraulic pump; an actuator driven by pressure oil from the hydraulic pump; a first on-off valve opening/closing a flow passage between the hydraulic pump and the actuator, a second on-off valve arranged in parallel with the first on-off valve and opening/closing a flow passage between the hydraulic pump and the actuator; a first directional switching valve capable of switching between a first position and a second position, the first position allowing the first on-off valve and the actuator to communicate with each other, and the second position shutting off the first on-off valve and the actuator from each other; a second directional switching valve capable of switching between a third position and a fourth position, the third position shutting off the second on-off valve and the actuator from each other, and the fourth position allowing the second on-off valve and the actuator to communicate with each other; a recording device recording an operation state of the first on-off valve and the second on-off valve with lapse of time; and a controller controlling switching operation of the first directional switching valve and the second directional switching valve based on history data with respect to an operation state of the first on-off valve and the second on-off valve recorded in the recording device, in which the controller opens the first on-off valve, closes the second on-off valve, switches the first directional switching valve to the first position, switches the second directional switching valve to the third position, thereby supplies pressure oil from the hydraulic pump from the first on-off valve to the actuator through the first directional switching valve, and when the history data of the first on-off valve is determined to satisfy a prescribed condition, closes the first on-off valve, opens the second on-off valve, switches the first directional switching valve to the second position, switches the second directional switching valve to the fourth position, and thereby supplies pressure oil from the hydraulic pump from the second on-off valve to the actuator through the second directional switching valve.

Advantageous Effects of Invention

According to the present invention, the number of times of maintenance of the hydraulic drive device for a working machine can be reduced. Also, problems, configurations, and effects other than those described above will be clarified by explanation of embodiments described below.

DESCRIPTION OF EMBODIMENTS

Figure 1:
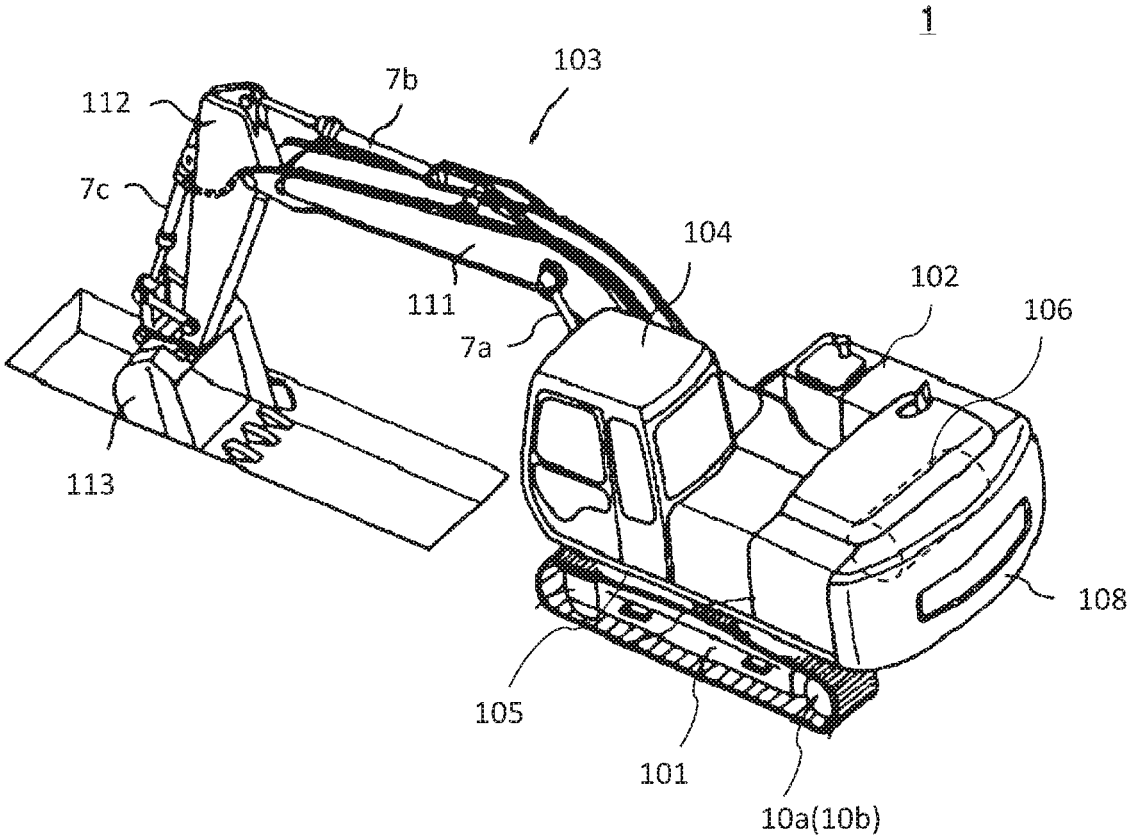
FIG. 1 is a perspective view of an outer appearance of a hydraulic excavator.

Respective embodiments of the present invention will be hereinafter explained referring to the drawings. Also, in each drawing, a same element will be marked with a same reference sign, and duplicated explanation thereof will be omitted.

First Embodiment

Explanation will be hereinafter given on an example where a hydraulic drive device related to a first embodiment of the present invention is applied to a hydraulic excavator that is a representative example of the working machine.

(Outer Appearance of Hydraulic Excavator)

FIG. 1 is a perspective view of an outer appearance of a hydraulic excavator 1 to which a hydraulic drive device related to the first embodiment is applied. The hydraulic excavator 1 shown in FIG. 1 includes an undercarriage 101 and an upper structure 102. The undercarriage 101 includes a pair of left and right crawler tracks, and traveling motors 10*a*, 10*b* as actuators that imparts traveling power to a pair of the left and right crawler tracks. The upper structure 102 is made swingable with respect to the undercarriage 101 by a bearing mechanism (not illustrated) interposed between the undercarriage 101 and a swing motor (not illustrated) as an actuator. With respect to the upper structure 102, a working device 103 is mounted on the front part of a main frame 105, a counterweight 108 is mounted on the rear part, and a cab 104 is mounted on the left front part. In front of the counterweight 108, there are stored an engine 106 as a prime mover, and a drive system (not illustrated) driven by a driving output from the engine 106.

The working device 103 is a front working device for executing a work such as excavation, and includes a boom 111, a boom cylinder 7*a* as an actuator driving the boom 111, an arm 112, an arm cylinder 7*b* as an actuator driving the arm 112, a bucket 113, and a bucket cylinder 7*c* as an actuator driving the bucket 113.

(Configuration of Hydraulic Drive Device)

Figure 2:
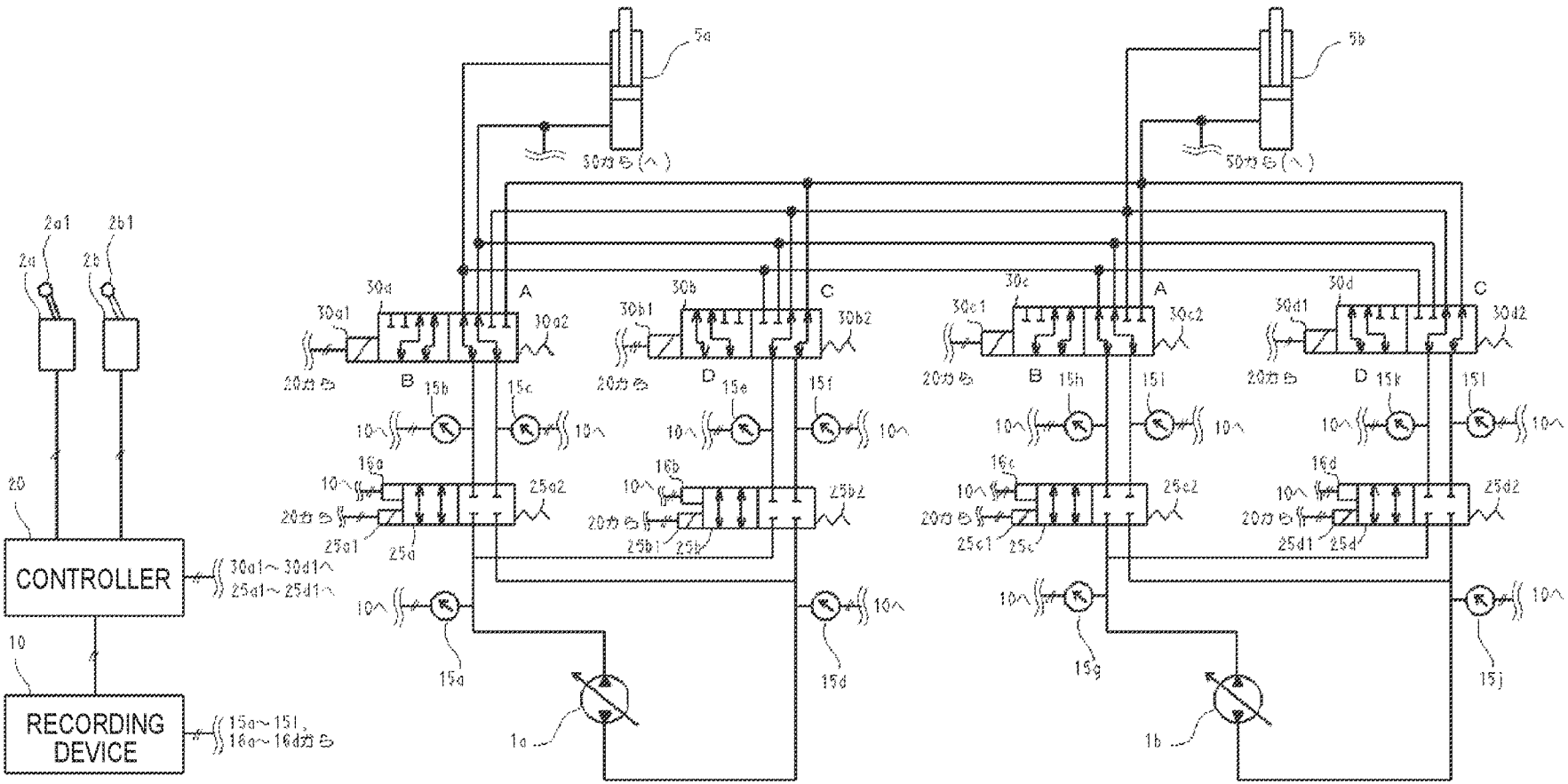
FIG. 2 is a hydraulic circuit diagram which shows an essential configuration of a hydraulic drive device provided in the hydraulic excavator.

FIG. 2 is a hydraulic circuit diagram which shows an essential configuration of a hydraulic drive device related to the first embodiment of the present invention provided in the hydraulic excavator 1. Also, in FIG. 2, a configuration of an engine and the like is omitted. As shown in FIG. 2, the hydraulic drive device for driving the hydraulic excavator 1 is configured by that closed circuit pumps (will be hereinafter abbreviated as "pump") 1*a*, 1*b*, actuators 5*a*, 5*b*, on-off valves 25*a*, 25*b*, 25*c*, 25*d*, and directional switching valves 30*a*, 30*b*, 30*c*, 30*d* are connected to each other in a closed circuit, the on-off valves 25*a*, 25*b*, 25*c*, 25*d* being arranged between the pumps 1*a*, 1*b* and the actuators 5*a*, 5*b*, the directional switching valves 30*a*, 30*b*, 30*c*, 30*d* being arranged between the actuators 5*a*, 5*b* and the on-off valves 25*a*, 25*b*, 25*c*, 25*d*.

Here, the pumps 1*a*, 1*b* are equivalent to "hydraulic pump" of the present invention, the actuators 5*a*, 5*b* are equivalent to "actuator" of the present invention, the on-off valves 25*a*, 25*c* are equivalent to "first on-off valve" of the present invention, the on-off valves 25*b*, 25*d* are equivalent to "second on-off valve" of the present invention, the directional switching valves 30*a*, 30*c* are equivalent to "first directional switching valve" of the present invention, and the directional switching valves 30*b*, 30*d* are equivalent to "second directional switching valve" of the present invention.

Also, the actuator 5*a* is an actuator whose frequency of usage is high, and is the boom cylinder 7*a*, the arm cylinder 7*b*, or the bucket cylinder 7*c*, for example. On the other hand, the actuator 5*b* is an actuator whose frequency of usage is low compared to the actuator 5*a*, and is the traveling motors 10*a*, 10*b*, for example.

To one end of the on-off valves 25*a* to 25*d*, springs 25*a*2, 25*b*2, 25*c*2, 25*d*2 are attached respectively, and solenoids 25*a*1, 25*b*1, 25*c*1, 25*d*1 are attached respectively to the other end. The on-off valves 25*a* to 25*d* are normally held to a closed position by an energizing force of the springs 25*a*2 to 25*d*2, and shut-off oil passages between the pumps 1*a*, 1*b* and the actuators 5*a*, 5*b*. Also, when the solenoids 25*a*1 to 25*d*1 are excited by electric signals from a controller 20, the on-off valves 25*a* to 25*d* are switched to an open position, and oil passages between the pumps 1*a*, 1*b* and the actuators 5*a*, 5*b* communicate.

Figure 3:
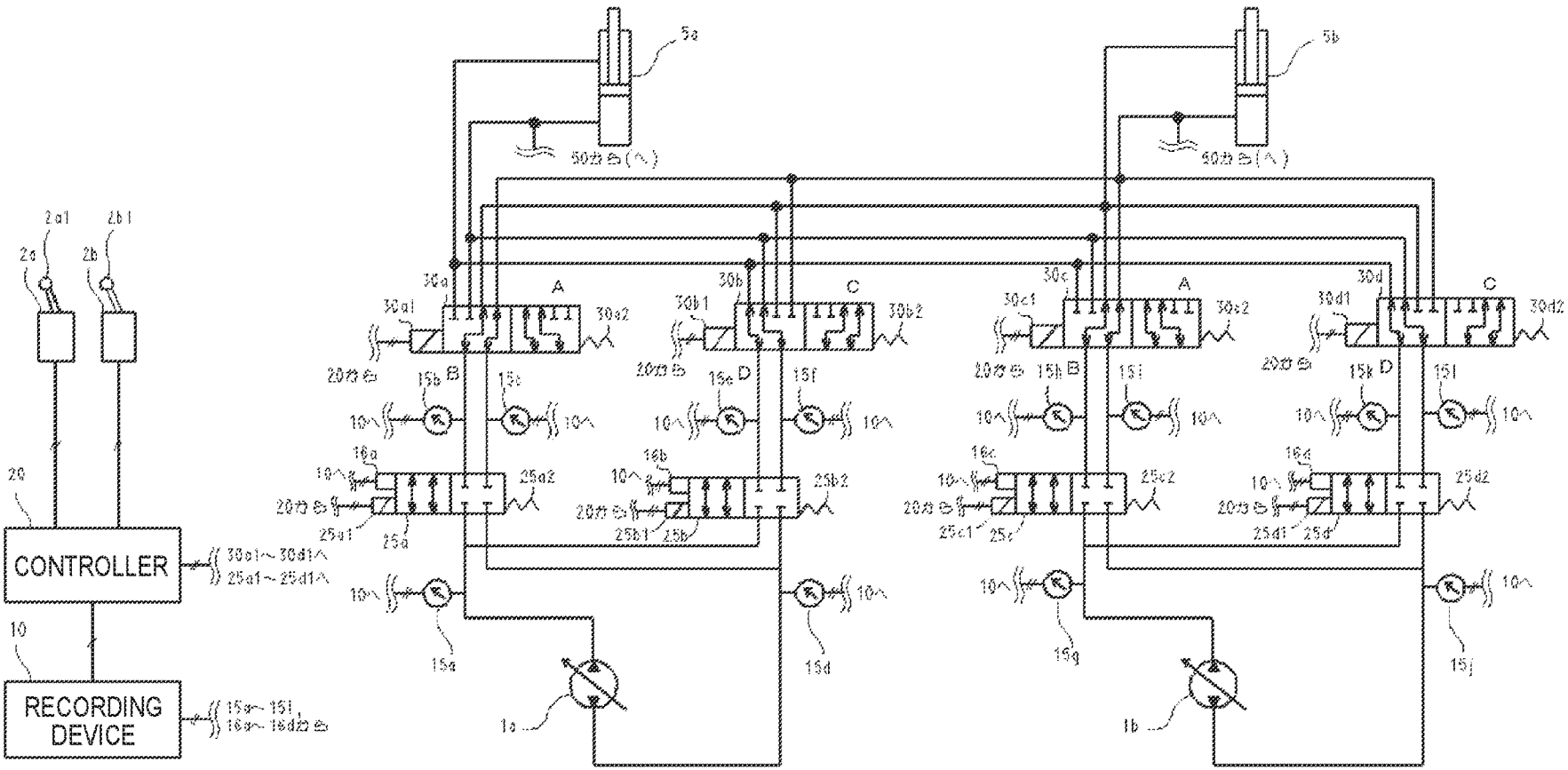
FIG. 3 is a hydraulic circuit diagram which shows a state respective directional switching valves are switched in FIG. 2.

To one end of the directional switching valves 30*a*, 30*c*, springs 30*a*2, 30*c*2 are attached respectively, and solenoids 30*a*1, 30*c*1 are attached respectively to the other end. The directional switching valves 30*a*, 30*c* are normally held to a position A by an energizing force of the springs 30*a*2 30*c*2, and an oil passage between the on-off valve 25*a* and the actuator 5*a* and an oil passage between the on-off valve 25*c* and the actuator 5*a* communicate respectively. At this time, an oil passage between the on-off valve 25*a* and the actuator 5*b* and an oil passage between the on-off valve 25*c* and the actuator 5*b* are shut-off. Also, when the solenoids 30*a*1, 30*c*1 are excited by electric signals from the controller 20, the directional switching valves 30*a*, 30*c* are switched from the position A (the first position) to a position B (the second position), an oil passage between the on-off valve 25*a* and the actuator 5*b* and an oil passage between the on-off valve 25*c* and the actuator 5*b* communicate respectively as shown in FIG. 3, and an oil passage between the on-off valve 25*a* and the actuator 5*a* and an oil passage between the on-off valve 25*c* and the actuator 5*a* are shut-off. Thus, when the directional switching valves 30*a*, 30*c* are switched from the position A to the position B, the supply destination of the pressure oil from the pumps 1*a*, 1*b* is switched selectively from the actuator 5*a* to the actuator 5*b*.

Also, the directional switching valves 30*b*, 30*d* have a structure same to that of the directional switching valves 30*a*, 30*c*, but are different in that the supply destination of the pressure oil from the pumps 1*a*, 1*b* is switched selectively from the actuator 5*b* to the actuator 5*a* upon being switched from a position C (the third position) to a position D (the fourth position).

Further, when a hydraulic cylinder is to be used as the actuators 5*a*, 5*b*, since the volume of the pressure oil capable of being supplied is different between the rod side and the bottom side, in order to compensate the volume difference thereof (the volume difference of a rod entering portion), such circuit configuration is employed that a supply/discharge passage 50 is arranged on the bottom side of the actuators 5*a*, 5*b* to allow the excess/shortage portion of the hydraulic oil within the circuit to be discharged/supplied from/to this supply/discharge passage 50.

Displacement sensors 16*a*, 16*b*, 16*c*, 16*d* are arranged respectively in the on-off valves 25*a* to 25*d*, and are connected to the recording device 10 through electric wiring. Although the displacement sensors 16*a* to 16*d* are for detecting the opening/closing motion of the on-off valves 25*a* to 25*d*, other kinds of valve opening/closing detection means and the like will do instead of the displacement sensors 16*a* to 16*d*. Respective displacement amounts of the on-off valves 25*a* to 25*d* detected by the displacement sensors 16*a* to 16*d* are recorded in the recording device 10. The controller 20 can calculate the operation number of times and the like of the on-off valves 25*a* to 25*d* based on the respective displacement values recorded, and can impart commands to the directional switching valves 30*a* to 30*d*. Also, the recording device 10 is configured as a memory having a large storage volume such as an HDD, for example.

Pressure sensors 15*a*, 15*b*, 15*c*, 15*d*, 15*e*, 15*f*, 15*g*, 15*h*, 15*i*, 15*j*, 15*k*, 151 are arranged for detecting the pressure before/behind the on-off valves 25*a* to 25*d*, and are connected to the recording device 10 through electric wiring. Respective pressure data pieces detected by the pressure sensors 15*a* to 151 are recorded in the recording device 10. Based on the respective pressure data pieces and the passing flow rate recorded, the controller 20 can calculate products of the passing flow rate and the differential pressure between front and rear sides with respect to the on-off valves 25*a* to 25*d* described below in detail, and can impart commands to the directional switching valves 30*a* to 30*d*.

2*a*, 2*b* are operation lever devices, and are connected to the controller 20 through electric wiring. The operation lever devices 2*a*, 2*b* are configured to include operation levers 2*a*1, 2*b*1 for extending and contracting the actuators 5*a*, 5*b*, and are operated by an operator of the hydraulic excavator, for example.

The operation lever devices 2*a*, 2*b* include a detection device (not illustrated) that electrically detects the tilting amount of the operation levers 2*a*1, 2*b*1 namely the lever operation amount. The lever operation amount detected by the detection device is outputted to the controller 20 as a lever operation amount signal. The controller 20 opens/closes the on-off valves 25*a* to 25*d* based on the lever operation amount signal inputted. Also, the controller 20 is configured of a microcomputer, for example, and includes a CPU, a ROM, a RAM, a communication I/F, and the like.

(Performance of Hydraulic Drive Device)

Next, performance of the hydraulic drive device will be explained. Also, the explanation below presumes a case the pressure oil from the pumps 1*a*, 1*b* is made to converge and is fed to the actuators 5*a*, 5*b* to operate the actuators 5*a*, 5*b*, respectively.

When the operation lever 2*a*1 is tilted by the operator, a signal corresponding to the lever operation amount is outputted to the controller 20 from the operation lever device 2*a*. Receiving the output signal, the controller 20 imparts a current command to the solenoids 25*a*1, 25*c*1 of the on-off valves 25*a*, 25*c*, and the on-off valves 25*a*, 25*c* open since a thrust force of the solenoids 25*a*1, 25*c*1 exceeds a force of the springs 25*a*2, 25*c*2. When the on-off valves 25*a*, 25*c* open, the pressure oil from the pumps 1*a*, 1*b* is fed to the actuator 5*a* through the directional switching valves 30*a*, 30*c*, and can operate the actuator 5*a*.

On the other hand, when the operation lever 2*b*1 is tilted by the operator, a signal corresponding to the lever operation amount is outputted to the controller 20 from the operation lever device 2*b*. Receiving the output signal, the controller 20 imparts a current command to the solenoids 25*b*1, 25*d*1 of the on-off valves 25*b*, 25*d*, and the on-off valves 25*b*, 25*d* open since a thrust force of the solenoids 25*b*1, 25*d*1 exceeds a force of the springs 25*b*2, 25*d*2. When the on-off valves 25*b*, 25*d* open, the pressure oil from the pumps 1*a*, 1*b* is fed to the actuator 5*b* through the directional switching valve 30*b*, 30*d*, and can operate the actuator 5*b*.

At this time, the displacement sensors 16*a* to 16*d* arranged in the on-off valves 25*a* to 25*d* detect the displacement amount of the on-off valves 25*a* to 25*d*, and send a detection signal of the displacement amount to the recording device 10. In the recording device 10, the detection signal of the displacement amount is recorded as a time history waveform, and the operation number of times (the number of times of opening/closing) of the on-off valves 25*a* to 25*d* is counted from the waveform, and is recorded.

(Control Processing by Controller)

The recording device 10 outputs a history of the operation number of times of each of the on-off valves 25*a* to 25*d* to the controller 20. Upon receiving the history of the operation number of times of the each, the controller 20 calculates an average value of the operation number of times of the on-off valves 25*a* to 25*d* and a prescribed value S1 (prescribed value S1=(average value of the operation number of times of the on-off valves 25*a* to 25*d*)+(first allowable deviation amount α)) which will be described below in detail. When the operation number of times of any one of the on-off valves 25*a* to 25*d* exceeds the prescribed value S1, the controller 20 issues a switching command to a directional switching valve connected to an on-off valve whose operation number of times exceeds the prescribed value S1 and a directional switching valve connected to an on-off valve whose operation number of times is the smallest.

Figure 4:
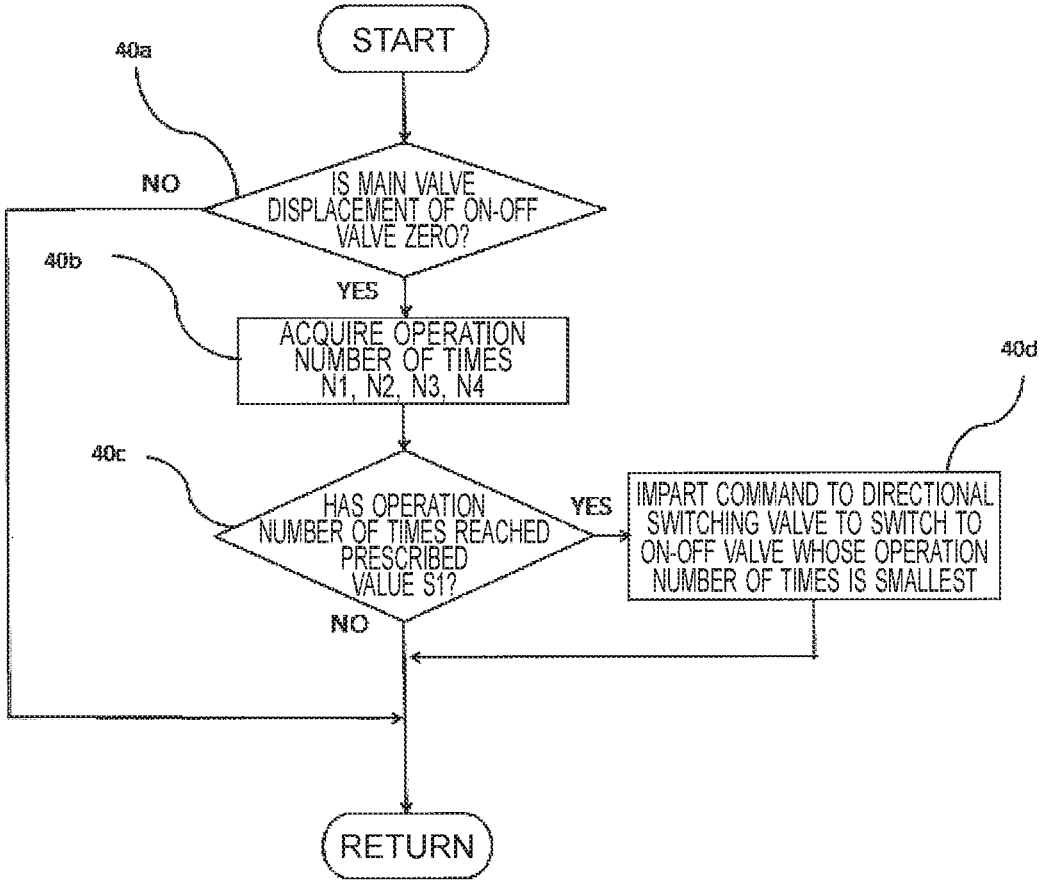
FIG. 4 is a flowchart which shows a switching procedure of the directional switching valves in a first embodiment.

Processing in the controller 20 at this time will be explained using FIG. 4. FIG. 4 is a flowchart which shows a switching procedure of the directional switching valves 30*a* to 30*d* in the first embodiment. First, the controller 20 determines whether the on-off valves 25*a* to 25*d* are closed in the step 40*a*. To be more specific, the controller 20 determines whether the on-off valves 25*a* to 25*d* are closed based on the displacement amount sent from the displacement sensors 16*a* to 16*d*. When the on-off valves 25*a* to 25*d* are not closed (step 40*a*/No), since the directional switching valves 30*a* to 30*d* are not switched, processing of that time is completed. When the on-off valves 25*a* to 25*d* are closed namely when the displacement amount is zero (step 40*a*/Yes), the process proceeds to the step 40*b*, and the controller 20 acquires operation a number of times N1, N2, N3, N4 of the on-off valves 25*a* to 25*d* from the recording device 10, and thereafter executes threshold determination of whether each operation number of times has reached the prescribed value S1 which is a threshold value in the step 40*c*.

Here, it is assumed that the operation number of times N1, N3 of the on-off valves 25*a*, 25*c* has reached the prescribed value S1. At that time, the process proceeds to the step 40*d*, and the controller 20 imparts a command to the directional switching valves 30*a*, 30*c* connected to the on-off valves 25*a*, 25*c* and switches the directional switching valves 30*a*, 30*c* from the position A to the position B. That is to say, the on-off valves 25*a*, 25*c* and the actuator 5*b* communicate with each other through the directional switching valves 30*a*, 30*c*. Also, at the same time, when an on-off valve whose operation number of times is the smallest is assumed to be the on-off valves 25*b*, 25*d*, in order to make the on-off valves 25*b*, 25*d* and the actuator 5*a* communicate with each other, a command is imparted to the directional switching valves 30*b*, 30*d* from the controller 20, and the directional switching valves 30*b*, 30*d* are switched from the position C to the position D. A state the directional switching valves 30*a* to 30*d* are switched is FIG. 3. Thus, it becomes possible to use the on-off valves 25*b*, 25*d* whose operation number of times is less. When such switching as described above occurs, the corresponding relation between the operation lever 2*a*1 and the on-off valves 25*b*, 25*d* is electrically switched by the controller 20 so as to open the on-off valves 25*b*, 25*d* according to a signal from the operation lever 2*a*1. Also, processing of the present flowchart is executed repeatedly at an interval of 0.1 second, for example, while the working machine works.

Figure 5:
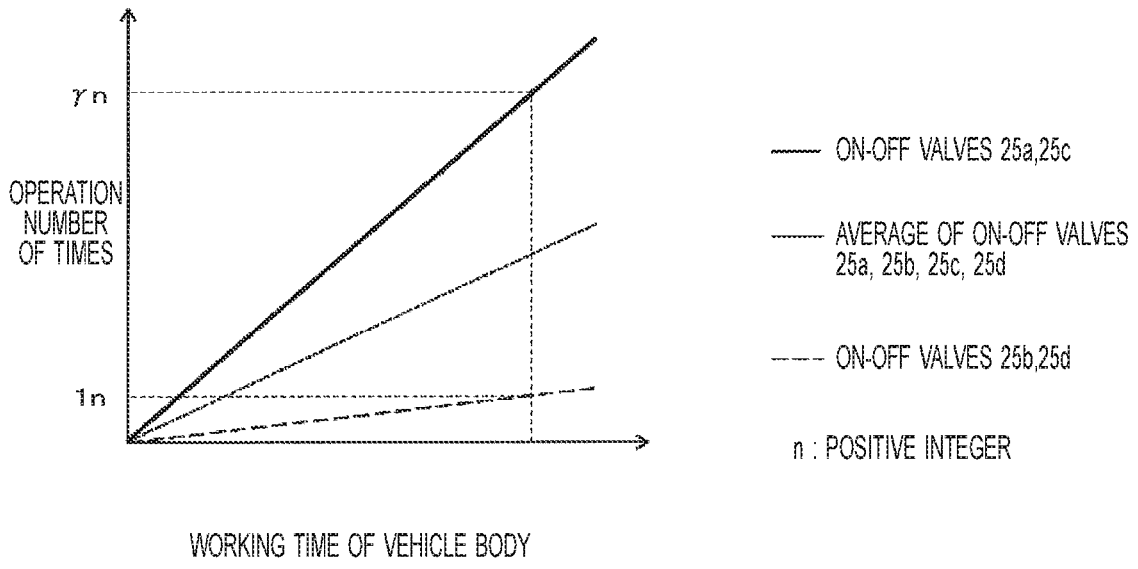
FIG. 5 is a drawing which shows a relation between the working time of a vehicle body and the operation number of times of on-off valves in a prior art.
Figure 6:
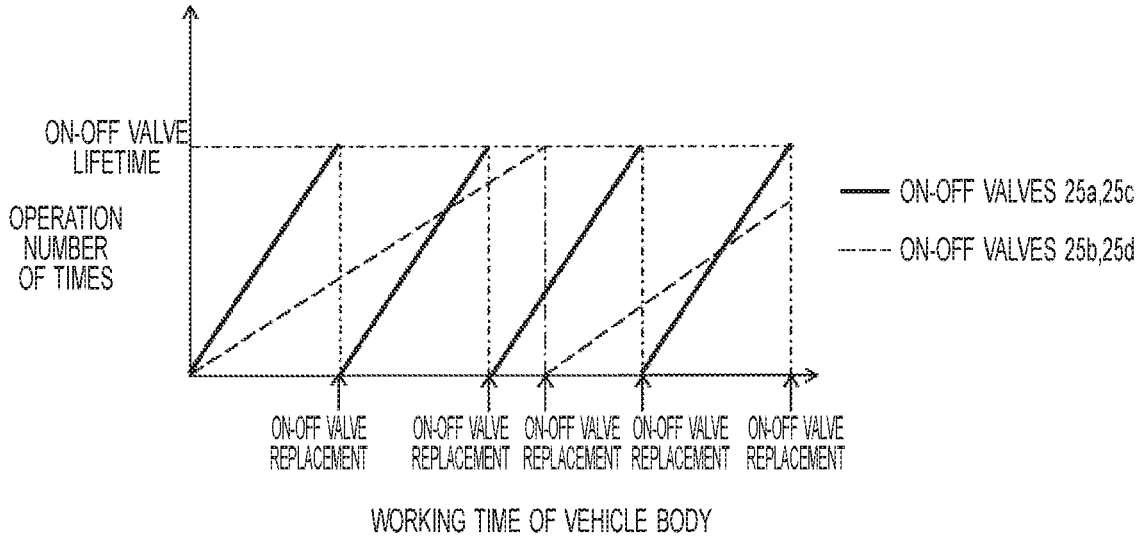
FIG. 6 is a drawing which shows the replacement timing of on-off valves in the prior art.

Next, a relation between the working time of a vehicle body and the operation number of times of an on-off valve will be explained comparing a prior art with the present embodiment. FIG. 5 is a drawing which shows a relation between the working time of a vehicle body and the operation number of times of on-off valves in a prior art. According to the prior art, since it is not controlled to average frequency of usage of the on-off valves 25*a* to 25*d*, when the working number of times ratio of the actuators 5*a* and 5*b* is assumed to be 5:1 for example, the operation number of times of the on-off valves 25*a*, 25*c* connected to the actuator 5*a* becomes γ times (γn/ln=γ times) larger with respect to the on-off valves 25*b*, 25*d* connected to the actuator 5*b*. Therefore, the displacement timing differs between the on-off valves 25*a*, 25*c* and the on-off valves 25*b*, 25*d*. FIG. 6 shows this situation. FIG. 6 shows the replacement timing of the on-off valves in the prior art, and the timing of expiration of the lifetime does not agree between the on-off valves 25*a*, 25*c* and the on-off valves 25*b*, 25*d* as shown in FIG. 6. Therefore, it is not possible to replace the on-off valves 25*a* to 25*d* at the same timing.

Figure 7:
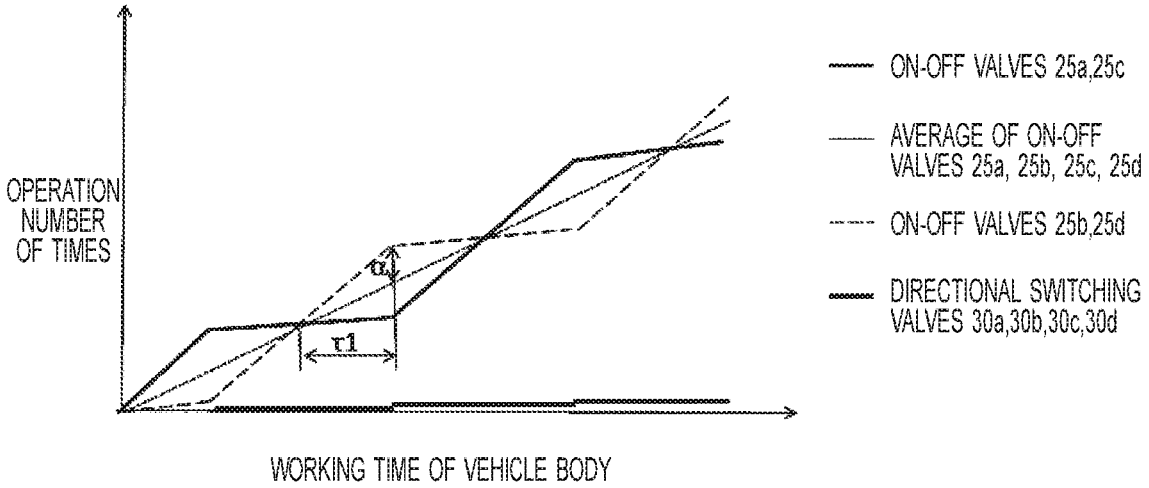
FIG. 7 is a drawing which shows a relation between the working time of a vehicle body and the operation number of times of the on-off valves in the first embodiment.

FIG. 7 shows a relation between the working time of a vehicle body and the operation number of times of the on-off valves in the first embodiment. According to the first embodiment, since it is configured that the directional switching valves 30*a* to 30*d* are switched when the operation number of times of the on-off valves 25*a* to 25*d* reaches the prescribed value S1, as shown in FIG. 7, when the first allowable deviation amount is set to a, the operation number of times of each of the on-off valves 25*a* to 25*d* can be averaged to a range of (the average value of the operation number of times of the on-off valves 25*a* to 25*d*)±α. That is to say, the expression of "prescribed value S1=((the average value of the operation number of times of the on-off valves 25*a* to 25*d*)±α) times" is fulfilled.

Figure 8:
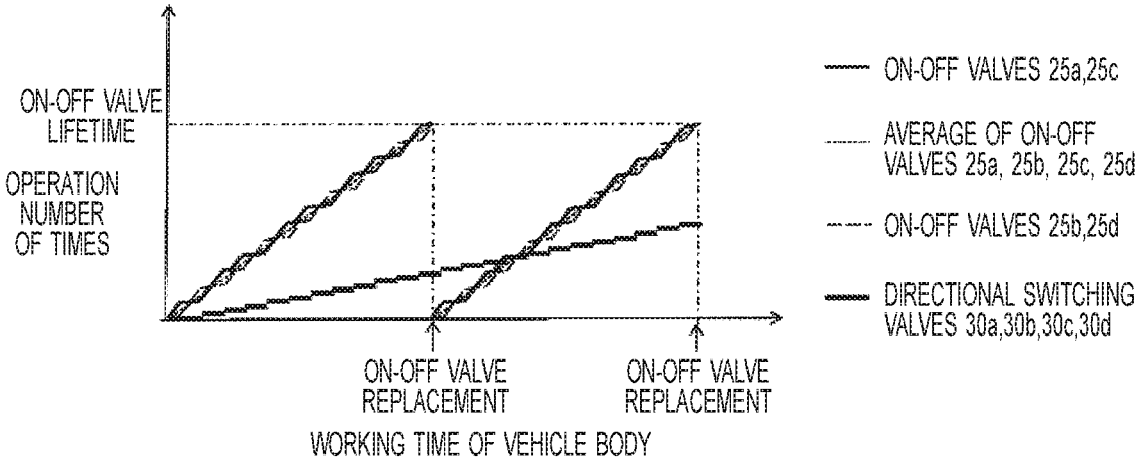
FIG. 8 is a drawing which shows the replacement timing of the on-off valves in the first embodiment.

Therefore, the replacement timing generally agrees between the on-off valves 25*a*, 25*c* and the on-off valves 25*b*, 25*d*. FIG. 8 shows this situation. FIG. 8 shows the replacement timing of the on-off valves in the first embodiment. As shown in FIG. 8, since the operation number of times of each of the on-off valves 25*a* to 25*d* is averaged, the lifetime of the on-off valves 25*a* to 25*d* expires at the same timing (timing identifiable to be the same). In other words, since the wear amount while the on-off valves 25*a* to 25*d* are operated is averaged, excess lifetime of the on-off valves 25*a* to 25*d* is not dispersed. As a result, all of the on-off valves 25*a* to 25*d* can be replaced at the same timing, and the number of times of maintenance and the maintenance cost can be reduced.

Here, when the average value of the operation number of times of the on-off valves 25*a* to 25*d* and the number of times of switching of the directional switching valves 30*a* to 30*d* are expressed to be m, n respectively, m, n have a relation of an expression (1) below.

$$M=\alpha(2n-1)(\gamma+1)/(\gamma-1) \text{ (wherein } n \text{ is an integer equal to or greater than 1)} \quad (1)$$

For example, in a case of (the working number of times ratio γ of the actuator)=100, when the first allowable deviation amount α is set to 10 and n of the time of m=10,000 times is calculated, the number of times n of changing of the directional switching valves 30*a* to 30*d* at that time point becomes 490 times (decimals are omitted). Therefore, by designing the directional switching valves 30*a* to 30*d* so as to have the lifetime of approximately 1/20 of that of the on-off valves 25*a* to 25*d*, replacement timing can be equalized. On the other hand, from a viewpoint of maintenance, since the number of times of switching of the directional switching valves 30*a* to 30*d* is approximately 1/20 of the average value of the operation number of times of the on-off valves 25*a* to 25*d*, such maintenance schedule can be planned that maintenance of the directional switching valves 30*a* to 30*d* is also executed one time out of 20 times of maintenance executed for the on-off valves 25*a* to 25*d*.

Thus, there is no more necessity of executing maintenance only for the directional switching valves 30*a* to 30*d*, and the number of times of maintenance can be reduced. Also, the lifetime ratio and the maintenance timing ratio of the on-off valves 25*a* to 25*d* and the directional switching valves 30*a* to 30*d* can be determined by imparting a suitable first allowable deviation amount a according to the expression (1) described above.

(First Modification)

In the step 40*c* of FIG. 4, even when processing of executing threshold determination whether a first specified time it (refer to FIG. 7) has elapsed after clock time when the operation number of times of the on-off valves 25*a* to 25*d* reaches the average value of the operation number of times of the on-off valves 25*a* to 25*d* is applied instead of processing of executing threshold determination whether the operation number of times of the on-off valves 25*a* to 25*d* respectively reaches the prescribed value S1, actions and effects similar to those of the first embodiment can be exerted. Here, the first specified time it can be expressed as $\tau 1=2\alpha/(\gamma-1)$.

Processing of the step 40*c* in this modification is as described below. That is to say, the recording device 10 records data of the clock time when the operation number of times of any one of the on-off valves 25*a* to 25*d* reaches the average value of the operation number of times of the on-off valves 25*a* to 25*d*, and outputs elapsed time from the clock time to the controller 20 point by point. When the elapsed time described above reaches the first specified time τ1, the controller 20 issues a switching command to a directional switching valve connected to an on-off valve whose number of times of operation is the largest among the on-off valves 25*a* to 25*d* and to a directional switching valve connected to an on-off valve whose number of times of operation is the smallest, and switches these directional switching valves from the position A to the position B or from the position C to the position D.

Second Embodiment

The feature of a second embodiment is that the controller 20 imparts a switching command to the directional switching valves 30*a* to 30*d* based on a cumulative value of products of the passing flow rate and the differential pressure between front and rear sides of the on-off valves 25*a* to 25*d*. The detail of processing by the controller 20 will be hereinafter explained.

Figure 9:
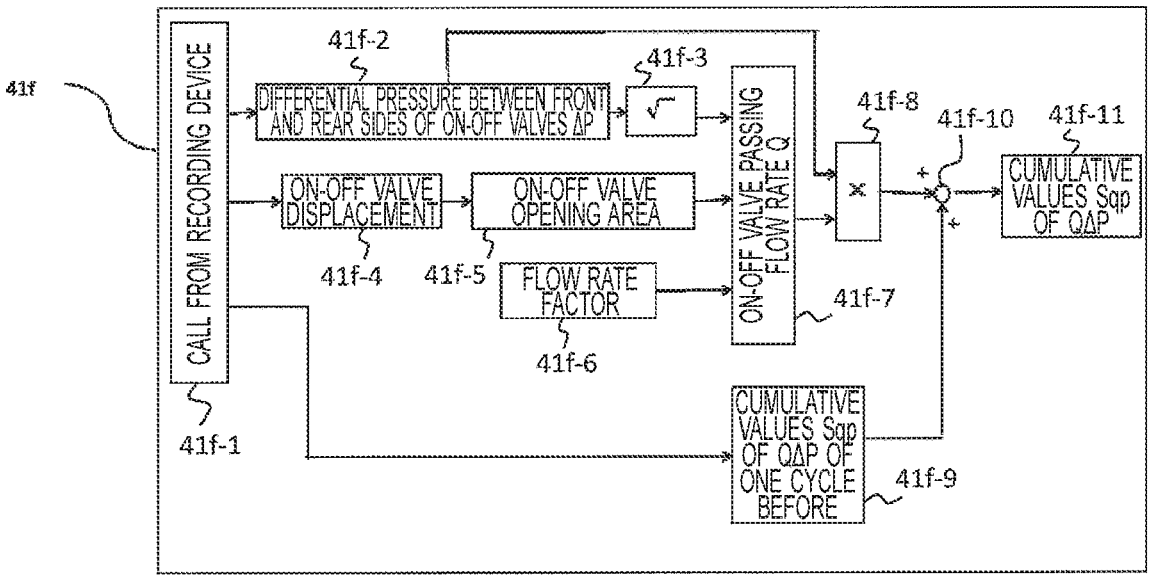
FIG. 9 is a block diagram of control processing of a controller in a second embodiment.

FIG. 9 is a block diagram 41*f* of control processing executed by the controller 20 in the second embodiment. As shown in FIG. 9, when a history outputted by the recording device 10 by calling out from the recording device 10 is received (41*f*-1), the controller 20 calculates differential pressure Δp between front and rear sides of the on-off valves 25*a* to 25*d* (41*f*-2), and obtains a square root of the differential pressure Δp between front and rear sides (41*f*-3). Also, the controller 20 acquires a displacement amount of the on-off valves 25*a* to 25*d* (41*f*-4), and obtains an open area of the on-off valves 25*a* to 25*d* (41*f*-5).

Next, the controller 20 obtains a passing flow rate Q of the on-off valves 25*a* to 25*d* (41*f*-7) from the square root of the differential pressure Δp between front and rear sides (41*f*-3), the open area of the on-off valves 25*a* to 25*d* (41*f*-5), and a flow rate factor (41*f*-6). Next, the controller 20 obtains QΔP that is a product of the differential pressure ΔP between front and rear sides (41*f*-2) and the passing flow rate Q (41*f*-7) with respect to each of the on-off valves 25*a* to 25*d* (41*f*-8), adds cumulative values Sqp1 to Sqp4 of QΔP (41*f*-9) of one cycle before to a value of each of QΔP (41*f*-10), and obtains new cumulative values Spq1 to Spq4 of QΔP of the on-off valves 25*a* to 25*d* (41*f*-11). Thereafter, the controller 20 adds a prescribed second allowable deviation amount β (refer to FIG. 13) to an average value of the cumulative values Sqp1 to Sqp4, and calculates a prescribed value S2.

When the cumulative values Sqp1 to Sqp4 of QΔP of any one of the on-off valves 25*a* to 25*d* exceeds the prescribed value S2, the controller 20 issues a switching command to a directional switching valve connected to an on-off valve whose cumulative values Sqp1 to Sqp4 of QΔP has exceeded the prescribed value S2 and to a directional switching valve connected to an on-off valve whose cumulative value of QΔP is the smallest.

Figure 10:
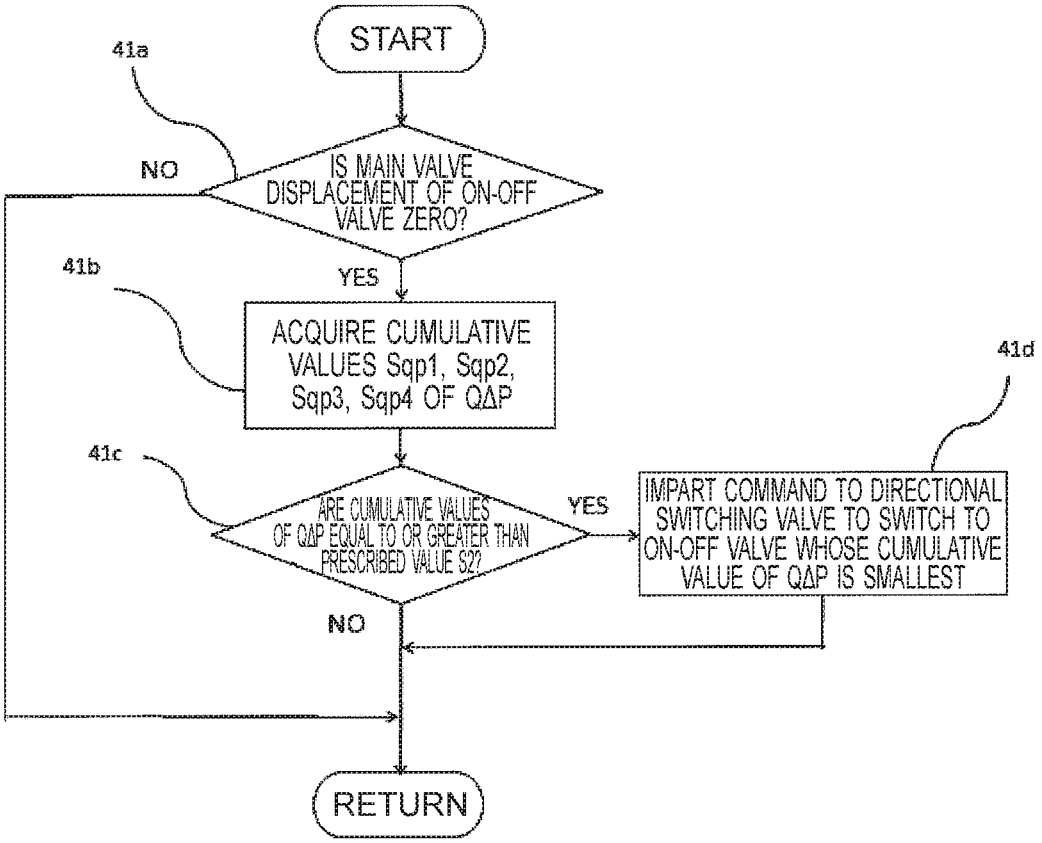
FIG. 10 is a flowchart which shows a switching procedure of directional switching valves in the second embodiment.

Processing in the controller 20 at this time will be explained using FIG. 10. FIG. 10 is a flowchart which shows a switching procedure of the directional switching valves 30*a* to 30*d* by the controller 20 in the second embodiment. First, the controller 20 determines whether the on-off valves 25*a* to 25*d* are closed in the step 41*a*. When the on-off valves 25*a* to 25*d* are not closed, namely when the displacement amount is not zero (step 41*a*/No), since the directional switching valves 30*a* to 30*d* are not switched, processing of that time is finished. When the on-off valves 25*a* to 25*d* are closed, namely when the displacement amount is zero (step 41*a*/Yes), the process proceeds to the step 41*b*, the controller 20 acquires the cumulative values Sqp1 to Sqp4 of QΔP of the on-off valves 25*a* to 25*d*, and executes threshold determination of whether each value of the cumulative values Sqp1 to Sqp4 is equal to or greater than the prescribed value S2 in the step 41*c*.

Here, it is assumed that the cumulative values Sqp1, Sqp3 of QΔP of the on-off valves 25*a*, 25*c* become equal to or greater than the prescribed value S2. At that time, the process proceeds to the step 41*d*, and the controller 20 imparts a command to the directional switching valves 30*a*, 30*c* connected to the on-off valves 25*a*, 25*c* respectively, and switches the directional switching valves 30*a*, 30*c* from the position A to the position B. That is to say, the on-off valves 25*a*, 25*c* and the actuator 5*b* communicate with each other through the directional switching valves 30*a*, 30*c*.

Also, when an on-off valve having the smallest cumulative value of QΔP is made the on-off valves 25*b*, 25*d*, in order to allow the on-off valves 25*b*, 25*d* and the actuator 5*a* to communicate with each other, simultaneously with switching of the directional switching valves 30*a*, 30*c*, a command is imparted from the controller 20 to the directional switching valves 30*b*, 30*d*, and the directional switching valves 30*b*, 30*d* are switched from the position C to the position D. Also, processing of the present flowchart is executed repeatedly at an interval of 0.1 second, for example, while the working machine works.

Figure 11:
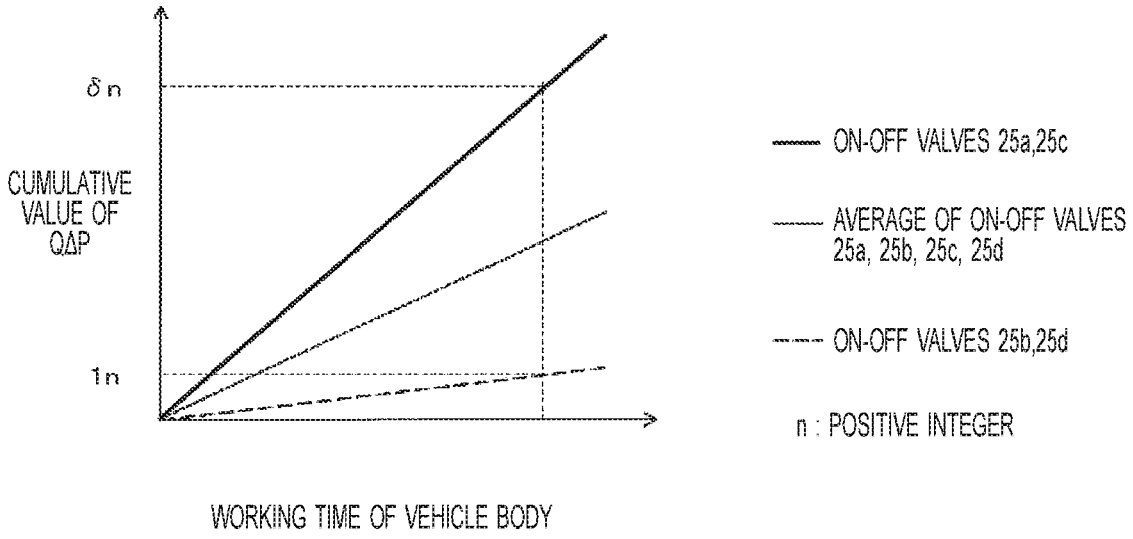
FIG. 11 is a drawing which shows a relation between the working time of a vehicle body and the cumulative value of QΔP of on-off valves in a prior art.
Figure 12:
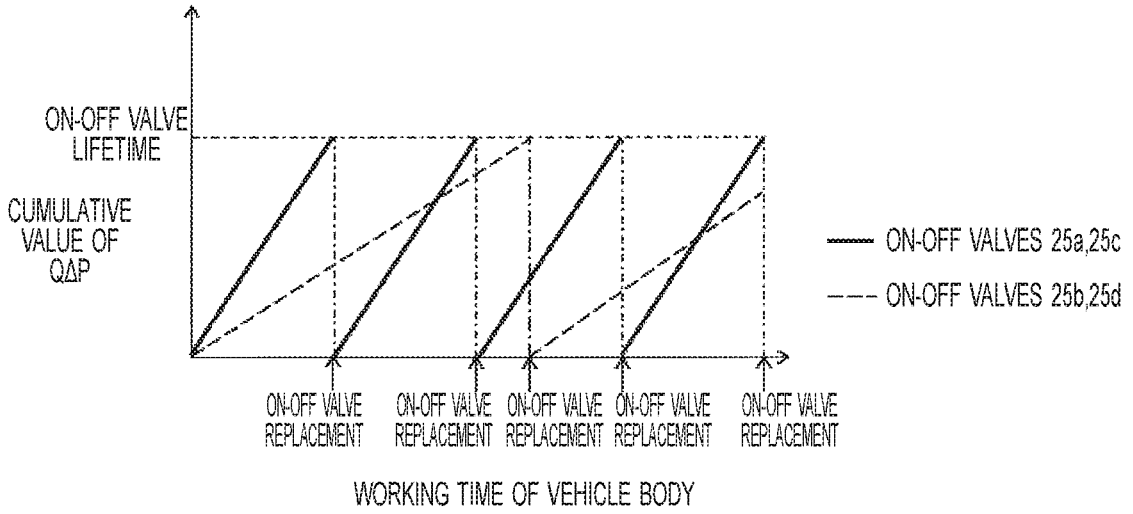
FIG. 12 is a drawing which shows the replacement timing of on-off valves in the prior art.

Next, a relation between the working time of the vehicle body and the operation number of times of the on-off valves will be explained comparing a prior art with the second first embodiment. FIG. 11 is a drawing which shows a relation between the working time of a vehicle body and the cumulative value of QΔP of on-off valves in a prior art. According to the prior art, since it is not controlled so as to average the frequency of usage of the on-off valves 25*a* to 25*d*, for example, when the cumulative value ratio of QΔP of the on-off valves 25*a* to 25*d* connected to the actuators 5*a*, 5*b* is made to be 5:1, the cumulative value of QΔP of the on-off valves 25*a*, 25*c* connected to the actuator 5*a* is δ times (δn/ln=δ times) greater with respect to the on-off valves 25*b*, 25*d* connected to the actuator 5*b*. Therefore, the replacement timing differs between the on-off valves 25*a*, 25*c* and the on-off valves 25*b*, 25*d*. FIG. 12 shows this situation. FIG. 12 shows the replacement timing of on-off valves in the prior art, and the timing of expiration of the lifetime does not agree between the on-off valves 25*a*, 25*c* and the on-off valves 25*b*, 25*d* as shown in FIG. 12. Therefore, it is not possible to replace the on-off valves 25*a* to 25*d* at same timing.

Figure 13:
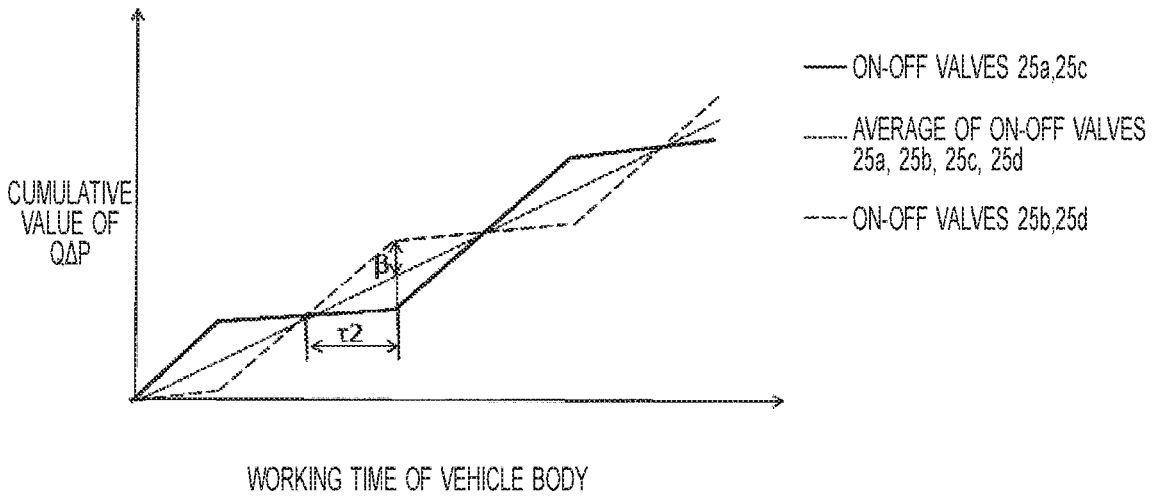
FIG. 13 is a drawing which shows a relation between the working time of a vehicle body and the cumulative value of QΔP of on-off valves in the second embodiment.

FIG. 13 shows a relation between the working time of a vehicle body and the cumulative value of QΔP of on-off valves in the second embodiment. According to the second embodiment, since it is configured to switch the directional switching valves 30*a* to 30*d* when the cumulative value of QΔP of the on-off valves 25*a* to 25*d* reaches the prescribed value S2, as shown in FIG. 13, when the second allowable deviation amount is set to R, the operation number of times of each of the on-off valves 25*a* to 25*d* is averaged so that the cumulative value of QΔP of the on-off valves 25*a* to 25*d* falls within a range of (the average value of QΔP of the on-off valves 25*a* to 25*d*)±β. That is to say, the expression of "prescribed value S2=((the average value of the cumulative value of QΔP of the on-off valves 25*a* to 25*d*)±β) times" is fulfilled.

Figure 14:
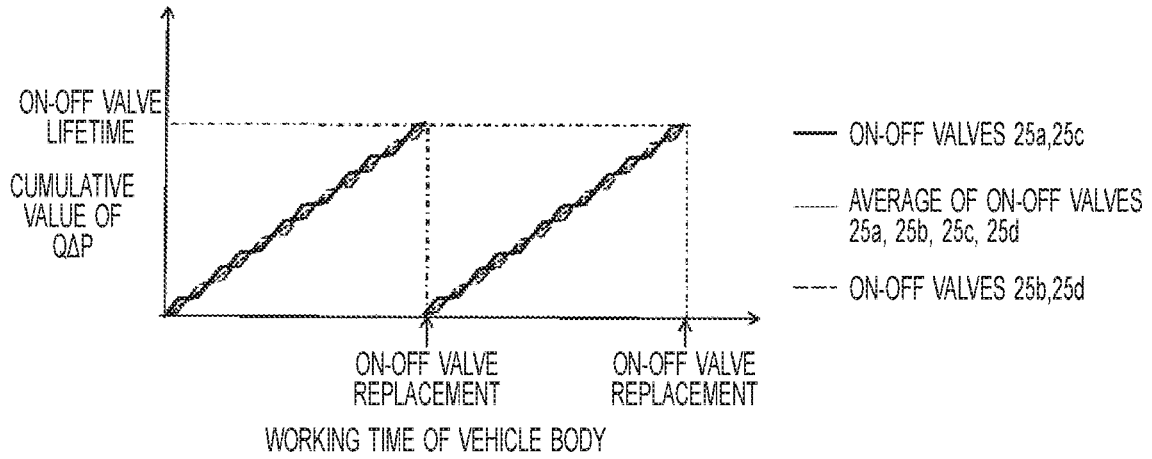
FIG. 14 is a drawing which shows the replacement timing of on-off valves in the second embodiment.

Therefore, the replacement timing generally agrees between the on-off valves 25*a*, 25*c* and the on-off valves 25*b*, 25*d*. FIG. 14 shows this situation. FIG. 14 shows the replacement timing of the on-off valves in the second embodiment. As shown in FIG. 14, since the cumulative value of QΔP of the on-off valves 25*a* to 25*d* is averaged, the risk of the wear caused by erosion is also averaged, and the lifetime of the on-off valves 25*a* to 25*d* expires at the same timing (timing identifiable to be the same). As a result, in a similar manner to the first embodiment, all of the on-off valves 25*a* to 25*d* can be replaced at the same timing, and the number of times of maintenance and the maintenance cost can be reduced.

(Second Modification)

In the step 41*c* of FIG. 10, even when processing of executing threshold determination whether a second specified time τ2 (refer to FIG. 13) has elapsed after clock time when the cumulative values Sgp1 to Sqp4 of QΔP of the on-off valves 25*a* to 25*d* reach the average value of the cumulative values of QΔP is applied instead of processing of executing threshold determination whether the cumulative values Sqp1 to Sqp4 of QΔP of the on-off valves 25*a* to 25*d* are equal to or greater than the prescribed value S2 respectively, actions and effects similar to those of the second embodiment can be exerted. Here, the second specified time τ2 can be expressed as $\tau 2=2\beta(\delta-1)$.

Processing of the step 41*c* in this second modification is as described below. That is to say, the recording device 10 records data of the clock time when a cumulative value of QΔP of any one of the on-off valves 25*a* to 25*d* reaches the average value of the cumulative values of QΔP, and outputs elapsed time from the clock time to the controller 20 point by point. When the elapsed time described above reaches the second specified time τ2, the controller 20 issues a switching command to a directional switching valve connected to an on-off valve whose cumulative value of QΔP is the largest among the on-off valves 25*a* to 25*d* and to a directional switching valve connected to an on-off valve whose cumulative value of QΔP is the smallest, and switches these directional switching valves from the position A to the position B or from the position C to the position D.

Third Embodiment

The feature of a third embodiment is that the controller 20 imparts a switching command to the directional switching valves 30*a* to 30*d* based on elapsed time from the clock time when switching of the directional switching valves 30*a* to 30*d* occurred last time. The detail of processing by the controller 20 will be hereinafter explained.

Figure 15:
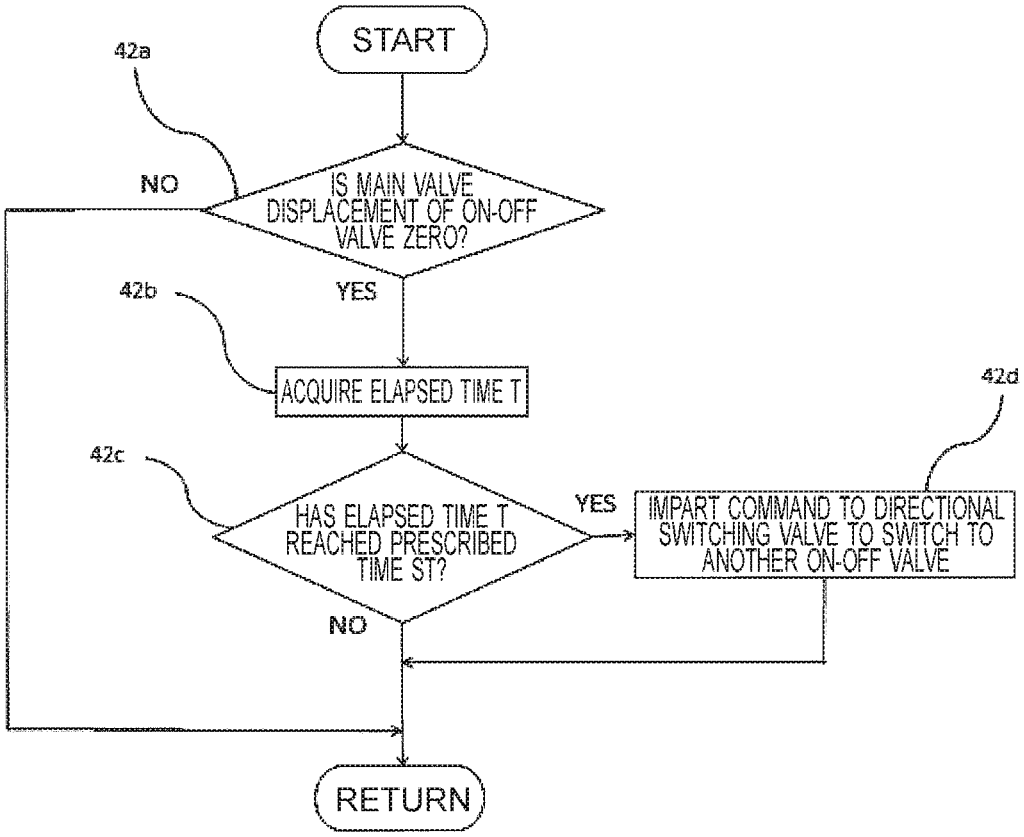
FIG. 15 is a flowchart which shows a switching procedure of directional switching valves in a third embodiment.

FIG. 15 is a flowchart which shows a switching procedure of the directional switching valves 30*a* to 30*d* by the controller 20 in the third embodiment. First, the controller 20 determines in the step 42*a* whether the on-off valves 25*a* to 25*d* are closed. When the on-off valves 25*a* to 25*d* are not closed, namely when the displacement amount is not zero (step 42*a*/No), since the directional switching valves 30*a* to 30*d* are not switched, processing of that time is finished. When the on-off valves 25*a* to 25*d* are closed, namely when the displacement amount is zero (step 42*a*/Yes), the process proceeds to the step 42*b*, the controller 20 acquires elapsed time T after clock time when switching occurred, and executes threshold determination in the step 42*c* whether the elapsed time T has reached a third specified time ST determined beforehand. The third specified time ST in this case may be a value obtained by analyzing the motion of the vehicle body used, and a value obtained by measuring the actuator working time of the actual vehicle body and being determined after considering the measurement result, for example. Also, when the elapsed time T has reached the third specified time ST (step 42*c*/Yes), the controller 20 proceeds to the step 42*d*, and switches the directional switching valves 30*a* to 30*d*. Also, processing of the present flowchart is executed repeatedly at an interval of 0.1 second, for example, while the working machine works.

Figure 16:
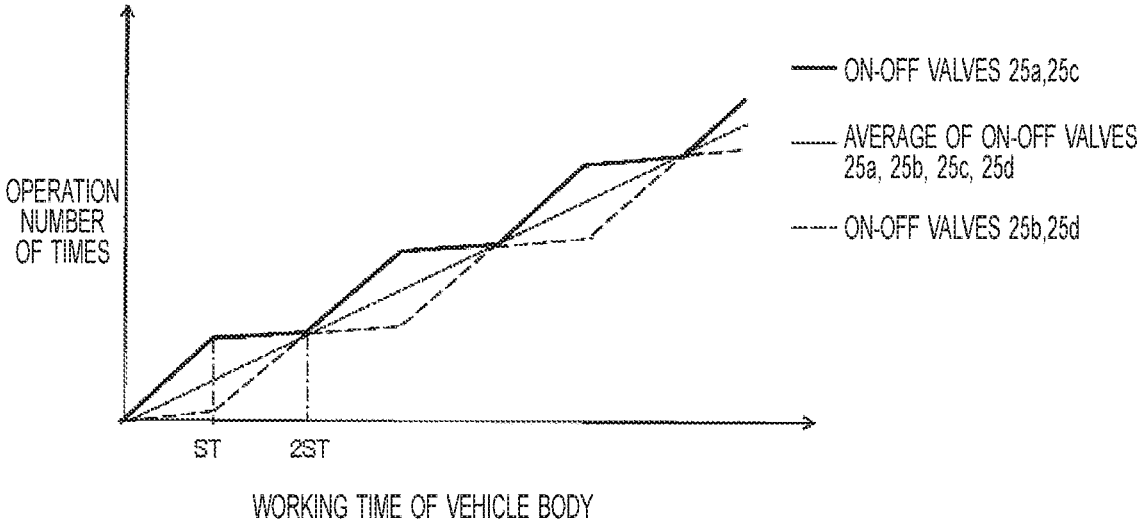
FIG. 16 is a drawing which shows a relation between the working time of a vehicle body and the operation number of times of on-off valves in the third embodiment.

Next, a relation between the working time of the vehicle body and the operation number of times of the on-off valves will be explained comparing a prior art with the third embodiment. Also, since the prior art is as per FIG. 5, explanation thereof will be omitted here. FIG. 16 shows a relation between the working time of a vehicle body and the operation number of times of on-off valves in the third embodiment. As shown in FIG. 16, according to the third embodiment, the operation number of times of the on-off valves 25*a* to 25*d* is averaged since the directional switching valves 30*a* to 30*d* are switched every third specified time ST. To be more specific, at every time of 2ST which is 2 times of the third specific time ST, the operation number of times of the on-off valves 25*a* to 25*d* takes the average value. Therefore, in all regions of the graph, the operation number of times of the on-off valves 25*a* to 25*d* can be averaged in a range of average value$\pm(\gamma-1)/(2(\gamma+1))$.

Figure 17:
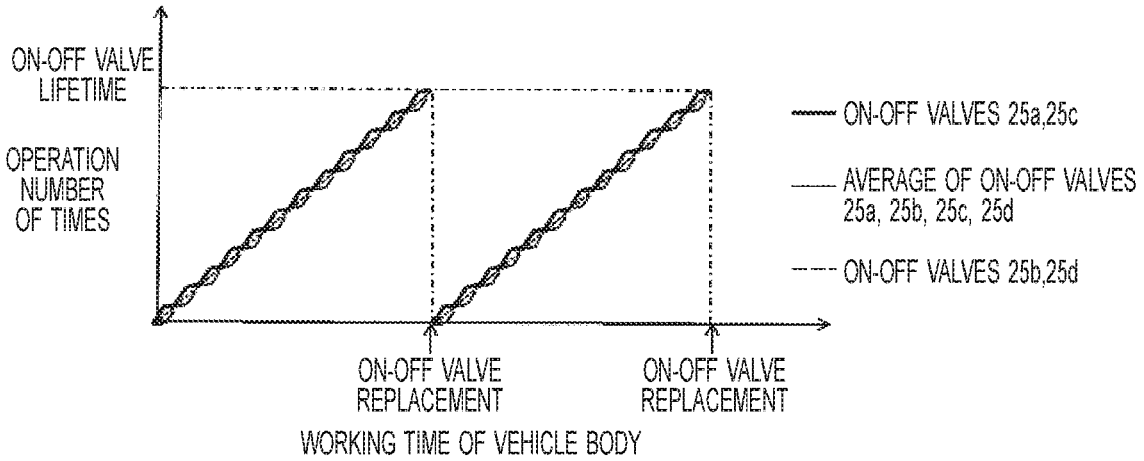
FIG. 17 is a drawing which shows the replacement timing of on-off valves in the third embodiment.

FIG. 17 is a drawing which shows the replacement timing of on-off valves in the third embodiment. As shown in FIG. 17, according to the third embodiment, since the operation number of times of the on-off valves 25*a* to 25*d* is averaged, the lifetime of the on-off valves 25*a* to 25*d* expires at the same timing (timing identifiable to be the same). In other words, since the wear amount while the on-off valves 25*a* to 25*d* are operated is averaged, excess lifetime of the on-off valves 25*a* to 25*d* is not dispersed. As a result, in a similar manner to the first and second embodiments, all of the on-off valves 25*a* to 25*d* can be replaced at the same timing, and the number of times of maintenance and the maintenance cost can be reduced. Also, according to the third embodiment, since it is configured to switch the directional switching valves 30*a* to 30*d* by the elapsed time T, it is advantageous in that the displacement sensors 16*a* to 16*d* and the pressure sensors 15*a* to 151 shown in FIGS. 2, 3 are not required.

Fourth Embodiment

The feature of a fourth embodiment is to be configured to execute switching control of the directional switching valves employing both of the first embodiment and the second embodiment. Since switching control of the directional switching valves by the first embodiment and switching control of the directional switching valves by the third embodiment may possibly conflict with each other, it is concerned that control hunting may occur. Therefore, in order to prevent control hunting, according to the fourth embodiment, the controller 20 executes preference control described below.

In executing this preference control, first, dimensionless numbers of the excess lifetime estimated from the operation number of times and the cumulative value of QΔP shown in expressions (2), (3) described below are considered.

Excess lifetime ratio *S*3 on operation number of times=(designed lifetime (times)−operation number of times (times))/designed lifetime (times) (2)

Excess lifetime ratio *S*4 on cumulative value of *QΔP*=(designed specified value of *QΔP* cumulative value−*QΔP* cumulative value)/designed specified value of *QΔP* cumulative value (3)

The controller 20 defines the excess lifetime ratio S3 on operation number of times and the excess lifetime ratio S4 on cumulative value of QΔP respectively, and determines which command based on determination of the operation number of times (the first condition) or the cumulative value of QΔP (the second condition) is to be given priority from the magnitude relation thereof. The detail of control by the controller 20 will be hereinafter explained.

Figure 18:
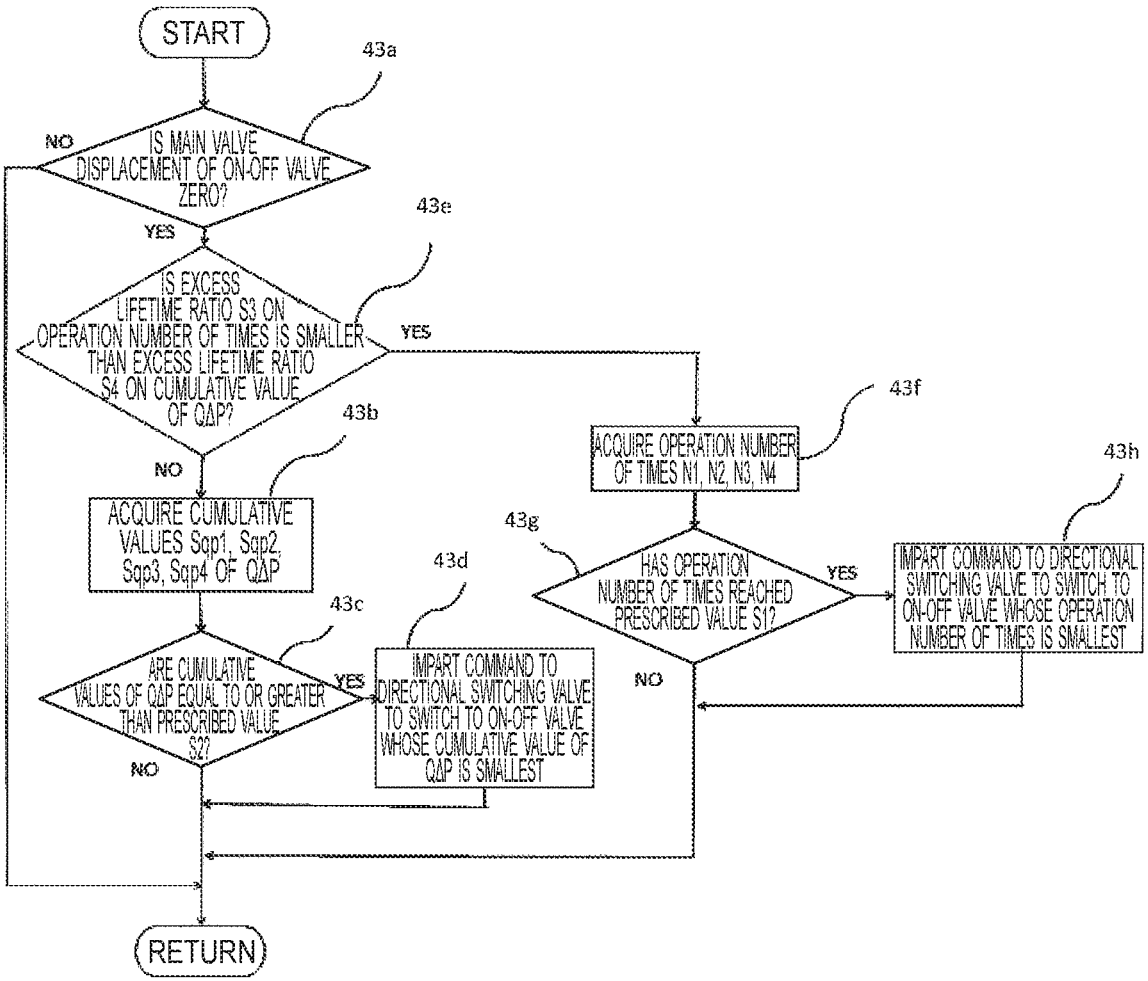
FIG. 18 is a flowchart which shows a switching procedure of directional switching valves in a fourth embodiment.

FIG. 18 is a flowchart which shows a switching procedure of the directional switching valves 30*a* to 30*d* by the controller 20 in the fourth embodiment. First, the controller 20 determines in the step 43*a* whether the on-off valves 25*a* to 25*d* are closed. When the on-off valves 25*a* to 25*d* are not closed, namely when the displacement amount is not zero (step 43*a*/No), since the directional switching valves 30*a* to 30*d* are not switched, processing of that time is finished. When the on-off valves 25*a* to 25*d* are closed, namely when the displacement amount is zero (step 43*a*/Yes), the controller 20 calculates the excess lifetime ratio S3 on operation number of times and the excess lifetime ratio S4 on cumulative value of QΔP and determines the magnitude relation of the excess lifetime ratio S3 and the excess lifetime ratio S4 in the step 43*e*.

The process proceeds to the step 43*f* when the excess lifetime ratio S3 on operation number of times is smaller (step 43*e*/Yes), and the process proceeds to the step 43*b* when the excess lifetime ratio S4 on cumulative value of QΔP is smaller. Since the operations thereafter are the same as those of the first embodiment and the second embodiment respectively, explanation thereof will be omitted. Also, processing of the present flowchart is executed repeatedly at an interval of 0.1 second, for example, while the working machine works.

According to the fourth embodiment, the number of times of usage of the on-off valves 25*a* to 25*d* is averaged considering the state amount history of one with smaller excess lifetime, and therefore, even when controls of both of the first embodiment and the second embodiment are combined, control hunting can be prevented.

Figure 19:
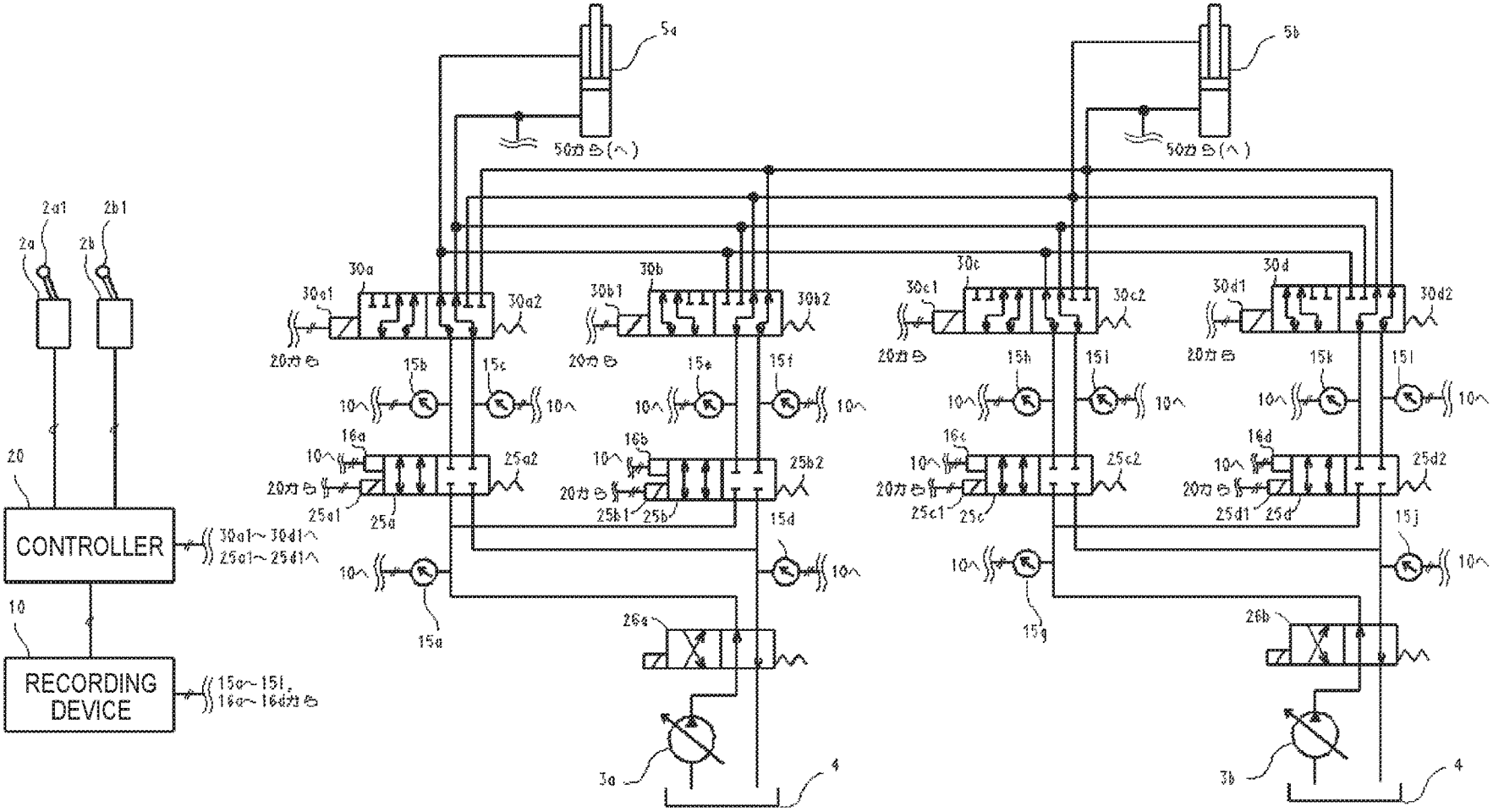
FIG. 19 is a hydraulic circuit diagram of a case the present invention is configured of an open circuit.

Further, although respective embodiments described above are examples where the present invention is applied to the hydraulic drive circuit of a closed circuit, the present invention can also be applied to a hydraulic drive circuit of an open circuit. FIG. 19 is an example of applying the present invention to an open circuit. As shown in FIG. 19, when the present invention is applied to an open circuit, it is required to substitute open circuit pumps 3*a*, 3*b* for the closed circuit pumps 1*a*, 1*b* of FIG. 2 and to arrange a tank 4 as a supply source and a discharge destination of the hydraulic oil and switching valves 26*a*, 26*b* for switching the supply destination of the hydraulic oil to the actuators 5*a*, 5*b* between the rod side or the bottom side.

Further, although respective embodiments described above have a hydraulic circuit configuration including two pumps 1*a*, 1*b*, four on-off valves 25*a* to 25*d*, and two actuators 5*a*, 5*b* as shown in FIG. 2, the present invention can be applied when a hydraulic circuit configuration includes at least one pump, two on-off valves, and one actuator. In that case, the excess lifetime comes to be averaged between two on-off valves. It is a matter of course and is needless to mention that the present invention can also be applied to a hydraulic circuit configuration including three or more pumps, five or more on-off valves, and three or more actuators.

The present invention is not limited to the embodiments described above, and various modifications are included therein. For example, the embodiments described above were explained in detail to explain the present invention to allow easy understanding, and are not necessarily limited to one including all configurations having been explained.

REFERENCE SIGNS LIST

1 . . . hydraulic excavator (working machine)
1*a*, 1*b* . . . closed circuit pump (hydraulic pump)
5*a*, 5*b* . . . actuator
10 . . . recording device
15*a* to 151 . . . pressure sensor
16*a* to 16*d* . . . displacement sensor
20 . . . controller
25*a*, 25*c* . . . on-off valve (first on-off valve)
25*b*, 25*d* . . . on-off valve (second on-off valve)
30*a*, 30*c* . . . directional switching valve (first directional switching valve)
30*b*, 30*d* . . . directional switching valve (second directional switching valve)

The invention claimed is:

1. A hydraulic drive device for a working machine, comprising:

a hydraulic pump;

an actuator driven by pressure oil from the hydraulic pump;

a first on-off valve opening/closing a flow passage between the hydraulic pump and the actuator;

a second on-off valve arranged in parallel with the first on-off valve and opening/closing a flow passage between the hydraulic pump and the actuator;

a first directional switching valve capable of switching between a first position and a second position, the first position allowing the first on-off valve and the actuator to communicate with each other, and the second position shutting off the first on-off valve and the actuator from each other;

a second directional switching valve capable of switching between a third position and a fourth position, the third position shutting off the second on-off valve and the actuator from each other, and the fourth position allowing the second on-off valve and the actuator to communicate with each other;

a recording device recording an operation state of the first on-off valve and the second on-off valve with lapse of time; and a controller controlling switching operation of the first directional switching valve and the second directional switching valve based on history data with respect to an operation state of the first on-off valve and the second on-off valve recorded in the recording device, wherein the controller opens the first on-off valve, closes the second on-off valve, switches the first directional switching valve to the first position, switches the second directional switching valve to the third position, thereby supplies pressure oil from the hydraulic pump from the first on-off valve to the actuator through the first directional switching valve, and when the history data of the first on-off valve is determined to satisfy a prescribed condition, closes the first on-off valve, opens the second on-off valve, switches the first directional switching valve to the second position, switches the second directional switching valve to the fourth position, and thereby supplies pressure oil from the hydraulic pump from the second on-off valve to the actuator through the second directional switching valve.

2. The hydraulic drive device for a working machine according to claim 1, wherein when the first on-off valve is closed, the controller determines whether the history data of the first on-off valve satisfies the prescribed condition.

3. The hydraulic drive device for a working machine according to claim 1, wherein the recording device records an operation number of times of each of the first on-off valve and the second on-off valve as the history data, and the controller determines that the prescribed condition is satisfied when the operation number of times of the first on-off valve reaches a first prescribed value.

4. The hydraulic drive device for a working machine according to claim 3, wherein the first prescribed value is a value obtained by adding a first allowable deviation amount to an average value of the operation number of times of the first on-off valve and the operation number of times of the second on-off valve.

5. The hydraulic drive device for a working machine according to claim 1, wherein the recording device records an operation number of times of each of the first on-off valve and the second on-off valve as the history data, and the controller determines that the prescribed condition is satisfied when a first specified time elapses after a time point when the operation number of times of the first on-off valve reaches an average value of the operation number of times of the first on-off valve and the operation number of times of the second on-off valve.

6. The hydraulic drive device for a working machine according to claim 1, further comprising:

a plurality of displacement sensors and a plurality of pressure sensors, the displacement sensor detecting a displacement amount of the first on-off valve and the second on-off valve, the pressure sensor detecting pressure before/behind the first on-off valve and the second on-off valve, wherein the recording device records the displacement amount of the first on-off valve and the second on-off valve as the history data based on detection signals from the plurality of displacement sensors, and records the pressure before/behind the first on-off valve and the second on-off valve as the history data based on detection signals from the plurality of pressure sensors, the controller calculates each differential pressure between front and rear sides of the first on-off valve and the second on-off valve based on the pressure before/behind the first on-off valve and the second on-off valve recorded in the recording device, calculates each opening area of the first on-off valve and the second on-off valve based on the displacement amount of the first on-off valve and the second on-off valve recorded in the recording device, calculates each passing flow rate of the first on-off valve and the second on-off valve based on the each differential pressure between front and rear sides and the each opening area calculated, and calculates a cumulative value of products of the differential pressure between front and rear sides and the passing flow rate calculated for each of the first on-off valve and the second on-off valve, and the controller determines that the prescribed condition is satisfied when the cumulative value of the first on-off valve becomes equal to or greater than a second prescribed value.

7. The hydraulic drive device for a working machine according to claim 6, wherein the second prescribed value is a value obtained by adding a second allowable deviation amount to an average value of the cumulative value of the first on-off valve and the cumulative value of the second on-off valve.

8. The hydraulic drive device for a working machine according to claim 6, wherein the controller determines that the prescribed condition is satisfied when a second specified time elapses after a time point when the cumulative value of the first on-off valve reaches an average value of the cumulative value of the first on-off valve and the cumulative value of the second on-off valve.

9. The hydraulic drive device for a working machine according to claim 1, wherein the recording device records elapsed time after switching of the first on-off valve and the second on-off valve as the history data, and the controller determines that the prescribed condition is satisfied when the elapsed time of the first on-off valve elapses a third specified time.

10. The hydraulic drive device for a working machine according to claim 1, wherein a first condition and a second condition are set as the prescribed condition, and the controller determines whether the history data of the first on-off valve satisfies one condition selected out of the first condition and the second condition.

* * * * *